United States Patent [19]

Schlesener

[11] 4,090,665

[45] May 23, 1978

[54] REINFORCED CONCRETE TIE WITH EMBEDDED RAIL CLAMP MEANS

[75] Inventor: Milton E. Schlesener, Herington, Kans.

[73] Assignee: The Raymond Lee Organization, Inc., New York, N.Y.

[21] Appl. No.: 742,190

[22] Filed: Nov. 16, 1976

[51] Int. Cl.[2] ..... E01B 3/32; E01B 9/30

[52] U.S. Cl. ..... 238/86; 238/349; 238/377

[58] Field of Search ..... 238/84, 85, 86, 87, 238/90, 265, 297, 298, 300, 303, 349, 350, 372, 373, 377

[56] References Cited

U.S. PATENT DOCUMENTS

| | | | |
|---|---|---|---|
| 962,588 | 6/1910 | Randall et al. | 238/90 |
| 1,051,806 | 1/1913 | Eberhart | 238/377 |
| 1,384,070 | 7/1921 | Kapolkin | 238/265 |
| 3,558,050 | 1/1971 | Sonneville | 238/349 |

FOREIGN PATENT DOCUMENTS

| | | | |
|---|---|---|---|
| 418,951 | 7/1910 | France | 238/3 |
| 912,535 | 8/1946 | France | 238/85 |
| 1,192,919 | 10/1959 | France | 238/85 |
| 107,270 | 6/1898 | Germany | 238/349 |

*Primary Examiner*—Drayton E. Hoffman
*Assistant Examiner*—Carl Rowold
*Attorney, Agent, or Firm*—Howard I. Podell

[57] ABSTRACT

An assembly for fastening of railroad track incorporating a steel reinforced concrete tie with vertical thread steel sleeves welded to a reinforcement truss embedded in the concrete tie to which sleeves, track bolt assemblies may be threadably joined. A track bolt assembly includes a pair of hollow male threaded plugs, each threaded to a female thread in the opposed ends of a sleeve to retain a nut that is biased by a compression spring in the sleeve, to which nut, a track screw mounted to a hold-down block is engaged. With the hold-down block fixed against a track rail flange, the screw may be tightened in the nut of the sleeve to a pre-set tensile load as determined by the compression spring.

2 Claims, 9 Drawing Figures

55

55

REINFORCED CONCRETE TIE WITH EMBEDDED RAIL CLAMP MEANS

SUMMARY OF THE INVENTION

My invention is an assembly for fastening of railroad track incorporating a steel reinforced concrete tie with vertical thread steel sleeves welded to a reinforcement truss embedded in the concrete tie to which sleeves, track bolt assemblies may be threadably joined. A track bolt assembly includes a pair of hollow male threaded plugs, each threaded to a female thread in the opposed ends of a sleeve to retain a nut that is biased by a compression spring in the sleeve, to which nut, a track screw mounted to a hold-down block is engaged. With the hold-down block fixed against a track rail flange, the screw may be tightened in the nut of the sleeve to a pre-set tensile load as determined by the compression spring.

By means of my invention, the reinforced concrete ties may be set on a water resistant compacted base in the ground, since the concrete ties do not absorb ground water.

The steel reinforcement truss is in the shape of an upper rectangular shaped ring joined to a similar-shaped lower ring by diagonal braces to which the rings are welded, with four vertical sleeves welded to both rings at each end section of the reinforcement. A side section of each upper reinforcement ring extends through a side opening in the concrete of the tie to provide means for attachment of the tie to a hoist sling.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
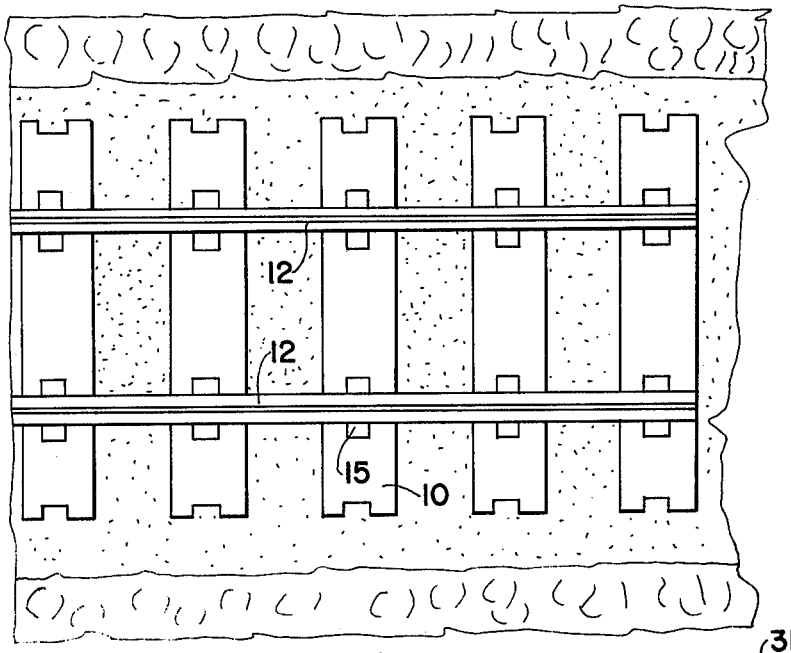
FIG. 1 is a plan view of the invention in use.
Figure 2:
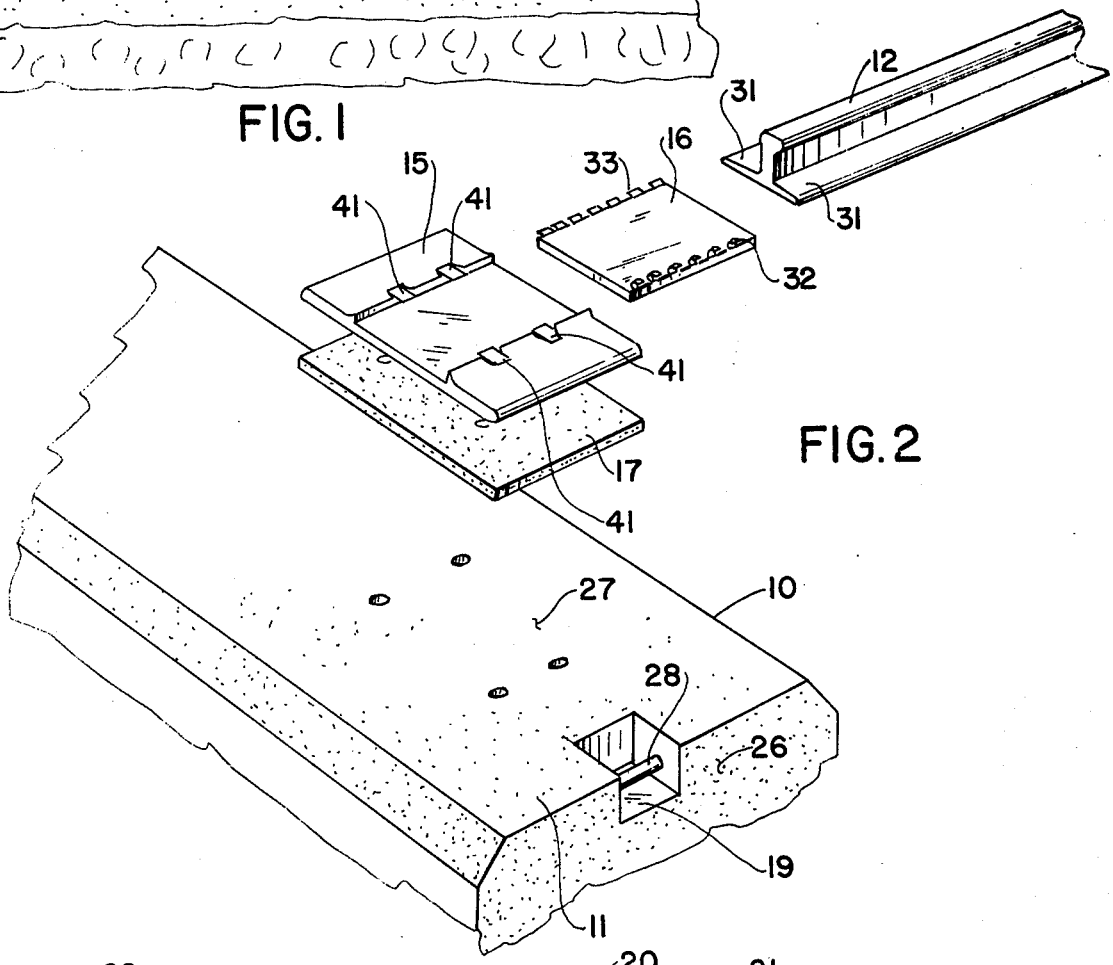
FIG. 2 is an exploded perspective view of the invention.
Figure 3:
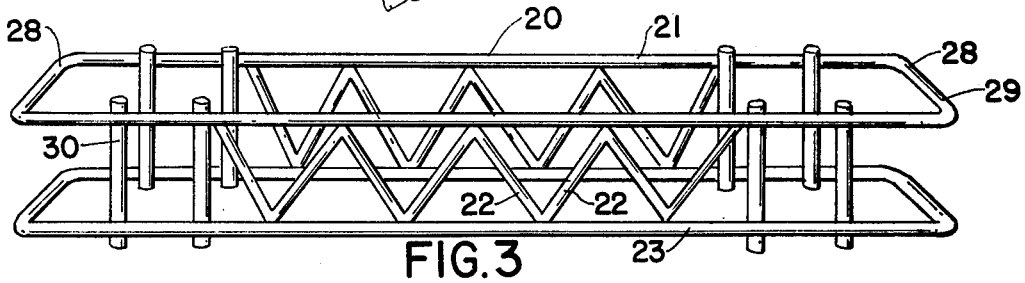
FIG. 3 is a perspective view of the reinforcement of the tie.
Figure 4:
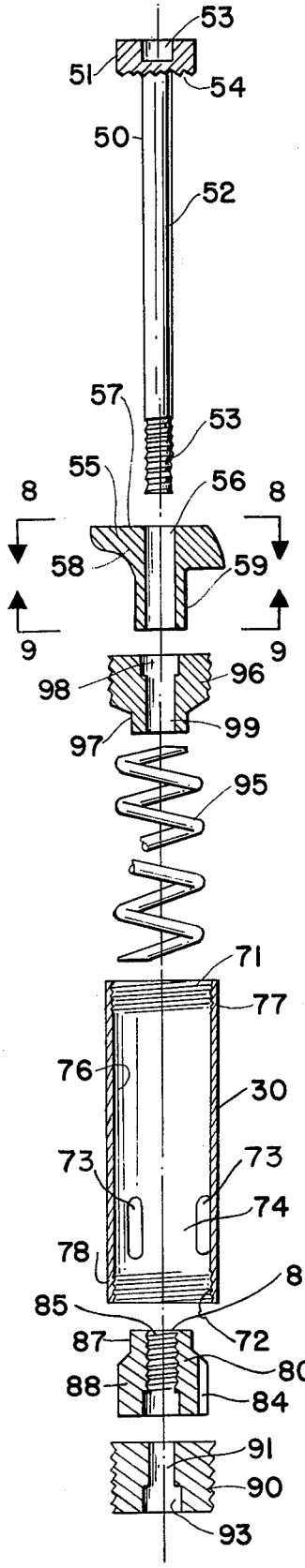
FIG. 4 is an exploded sectional view of the track bolt assembly and sleeve.

Turning now descriptively to the drawings, in which similar reference characters denote similar elements throughout the several views, FIGS. 1–2 illustrate the concrete tie 10 which consists of a reinforcement structure 20 embedded in concrete 11 to form a base to which railroad track rails 12 may be fastened.

Reinforcement structure 20 is formed of steel members welded together to form an integral structure. An upper rectangular ring 21 is fixed by diagonal braces 22 to a lower rectangular ring 23. Two sets of four vertical sleeves 30 are welded to both rings 21 and 23 on each side of the center line of the reinforcement structure 20 and with each sleeve located to align with one of the four stake holes 41 of a tie plate 15, so that two tie plates 15 spaced by the distance of the gauge of the track rails 12 may be bolted to the sleeves 15.

An open recess 19 is shaped in the upper mid-section of each end face 26 of tie 10 with each recess 19 open to the top face 27 of the tie, and with recess 19 located to clear a mid-section 28 of each end section 29 of the upper rectangular ring 21 of the reinforcement structure so that exposed section 28 serves as a grip for hoist sling (not shown) to fasten to the tie 10.

The flanges 31 of rail 12 are fastened to a tie-keeper plate 16 fastened under rail 12 by clips 32 and 33 on the opposed sides of the tie-keeper plate, with tie-keeper plate 16 mounted on a tie plate 15 that rests on a resilient pad 17 with each bolt 50 fastened to a sleeve 30 as described more fully in the following description.

Bolt 50 is formed with a head 51 joined to shank section 52 the end of which is threaded, and with an open square-spaced wrench grip recess 53 open to the top surface of head 51, with the undersurface of head 51 roughened to form serrations 54.

A bolt block 55 is mounted through circular hole 56 of the block about shank sections 52 of bolt 50 with top surface 57 bearing against the serrations 54 of the undersurface of bolt head 51. Block 55 is formed with a head section 57 tapering on one side to a flange 58 of a shape to fit about a rail flange 31, with head section 57 joined to a square shank section 59 of a size to non-rotatably fit into a square hole 41 of a tie plate 15. The upper surface 62 of head section 57 is roughened about the periphery of hole 56 so as to frictionally grip the serrations 54 of bolt head 51. Bolt block 55 is of a length such that the shank section 59 does not extend below the undersurface of a tie plate 15 in the assembled position.

Sleeve 30 is formed as a tubular collar and formed with internal female screw threads 71 and 72 at the upper and lower end sections 77 and 78 respectively of the sleeve. Three ribs 73, spaced 120° apart, are fixed to the lower section 74 of the internal wall 76 of sleeve 30 so as to non-rotatably engage three longitudinal grooves 84 of nut 80. Nut 80 is of generally cylindrical shape with an outer diameter of a size to clear the internal wall 76 of sleeve 60 when inserted from either end 77 or 78 of sleeve 60, and externally formed with three longitudinal grooves 84 spaced equidistantly about the external wall 88. The axial hole 86 of nut 80 is formed with a female screw thread 85 of a size to engage bolt threads 53.

A threaded plug 90 is initially engaged to the male threads 72 of lower end section 78 of sleeve 30, with plug 90 formed with a through hole 91 of a size to clear shank 52 and threads 53 of bolt 50, and with hole 91 shaped with an outer recessed section 93 of square cross-section for engagement with a wrench.

Nut 80 is dropped into a sleeve 30 from the upper sleeve end 77 and oriented to align with and engage sleeve ribs 71. A coil compression spring 95 then is inserted into sleeve 30 and held in place against nut 80 by threaded hollow plug 96, with spring 95 anchored by reduced neck section 87 of nut 80 and reduced neck section 97 of plug 96. Spring 95 is tightened to an initial pre-set compression by tightening plug 96 in threads 71 of sleeve 30, by inserting a square wrench into a square axial recess 98 in plug 96. Plug 96 is formed with a through axial hole 99 of a size to clear shank 52 of bolt 50.

Bolt 50 may now be tightened into sleeve 30, with bolt block 55 set against a rail flange and with thread 53 of bolt 50 engaging threads 85 so as to maintain bolt 50 under relatively uniform tension in use.

Figure 5:
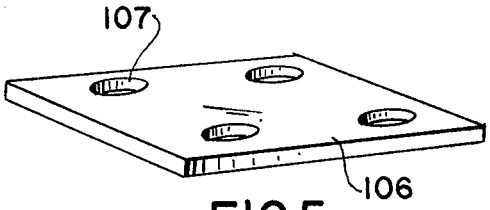
FIG. 5 is a perspective view of a plate to be used with wooden ties.
Figure 6:
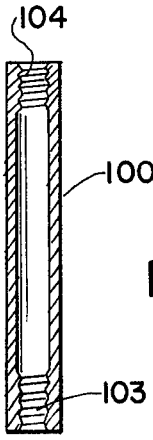
FIG. 6 is a sectional view of a sleeve to be employed with wooden ties.
Figure 7:
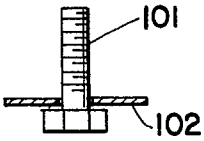
FIG. 7 is a side view of a screw to be employed with wooden ties.
Figure 9:
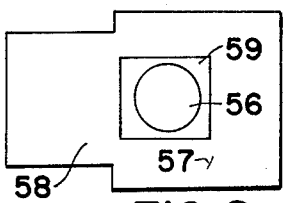
FIG. 9 is a bottom plan view of the bolt block, taken along line 9—9 of FIG. 4.
Figure 8:
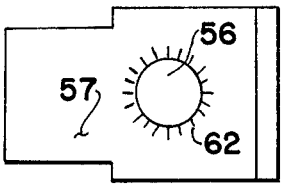
FIG. 8 is a top plan view of the bolt block, taken along line 8—8 of FIG. 4.

Alternately, existing wooden ties may be reworked by inserting sleeves 100 shown in FIG. 6 into holes drilled in the ties and fastening the sleeves from the bottom of the ties by screw 101 and washer 102 shown in FIG. 7 threaded into a female thread 103 in sleeve 30. A steel plate 106 shown in FIG. 5, shaped with four holes 107 may be mounted between the tie plate 15 and the wooden tie, with a track bolt (not shown) employed to mate with a female thread 104 in sleeve 100.

Since obvious changes may be made in the specific embodiment of the invention described herein, such modifications being within the spirit and scope of the invention claimed, it is indicated that all matter described herein is intended as llustrative and not as limiting in scope.

Having thus described the invention, what I claim as new and desire to secure by Letters Patent of the United States is:

1. A reinforced concrete tie for use in supporting a track rail comprising a metal reinforcement structure embedded in concrete, said reinforcement structure in the form of a pair of spaced parallel rectangular shaped rings joined by diagonal braces, with each ring joined to a plurality of hollow sleeves internally embedded in the concrete and each mounted perpendicular to the planes of the rings, said sleeves formed with means to fasten to bolts, said sleeves each formed with an axial opening that communicates with an opening in the top surface of the tie so that a bolt fastened in the sleeve may extend above the tie for fastening a track rail to the tie, in which each sleeve is formed with internal threads for fastening to a first hollow plug and formed with a non-circular internal section of a shape to non-rotatably slidably engage a shaped threaded nut, together with said nut which is fastened in said sleeve between a coil spring mounted between said hollow plug and said nut, said non-circular internal section located in each sleeve further from the top surface of said tie than the said internal threads so that a bolt inserted from the top surface of the tie extends through said hollow plug, through the interior of said coil spring to engage the threads of the shaped threaded nut, in which said sleeve is internally fitted with bottoming means to limit the axial travel of the shaped threaded nut in the direction away from the top surface of the tie, said coil spring serving to apply a pre-stress load to the sleeve and to the concrete tie when the plug is rotated in the engaged threads of the plug and sleeve so as to compress the coil spring against the shaped threaded nut, and compress the shaped threaded nut against the bottoming means of the sleeve, with said pre-stress load that is applied to the compressed spring being additive to the compressive load applied to the spring by the tension of a bolt fastened against a track rail resting on a tie and engaged to the internal threads of the said shaped nut.

2. The combination as recited in claim 1 in which the bottoming means of the sleeve is in the form of a second hollow threaded plug that is threadably engaged to the sleeve in an end section of the sleeve remote from the top surface of the tie.

* * * * *